US005482812A

United States Patent [19]

Hopper et al.

[11] Patent Number: 5,482,812

[45] Date of Patent: Jan. 9, 1996

[54] WAX CONTAINING TONER AGGREGATION PROCESSES

[75] Inventors: Michael A. Hopper, Toronto; Raj D. Patel, Oakville; Grazyna E. Kmiecik-Lawrynowicz, Burlington; Stephan V. Drappel, Toronto; Paul J. Gerroir, Oakville, all of Canada

[73] Assignee: Xerox Corporation, Stamford, Conn.

[21] Appl. No.: 344,060

[22] Filed: Nov. 23, 1994

[51] Int. Cl.[6] ..... G03G 9/087

[52] U.S. Cl. ..... 430/137; 523/335; 523/339

[58] Field of Search ..... 430/110, 137; 523/335, 339

[56] References Cited

U.S. PATENT DOCUMENTS

| | | | |
|---|---|---|---|
| 4,797,339 | 1/1989 | Maruyama et al. | 430/109 |
| 4,921,771 | 5/1990 | Tomono et al. | 430/110 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |

*Primary Examiner*—Roland Martin
*Attorney, Agent, or Firm*—E. O. Palazzo

[57] ABSTRACT

A process for the preparation of toner compositions or toner particles comprising:

(i) providing an aqueous pigment dispersion comprised of a pigment, an ionic surfactant, and optionally a charge control agent;

(ii) providing a wax dispersion comprised of wax, a dispersant comprised of nonionic surfactant, ionic surfactant or mixtures thereof;

(iii) shearing a mixture of the wax dispersion and the pigment dispersion with a latex or emulsion blend comprised of resin, a counterionic surfactant with a charge polarity of opposite sign to that of said ionic surfactant and a nonionic surfactant;

(iv) heating the above sheared blend below about the glass transition temperature (Tg) of the resin to form electrostatically bound toner size aggregates with a narrow particle size distribution;

(v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi);

(vi) heating the mixture of (v) with bound aggregates above about or at the Tg of the resin; and optionally (vii) separating the toner particles from the aqueous slurry by filtration and thereafter optionally washing.

31 Claims, No Drawings

WAX CONTAINING TONER AGGREGATION PROCESSES

BACKGROUND OF THE INVENTION

The present invention is generally directed to toners and toner processes, and more specifically to aggregation and coalescence processes for the preparation of toner compositions. In embodiments, the present invention is directed to the economical preparation of toners without the utilization of the known pulverization and/or classification methods, and wherein in embodiments toner compositions with a volume average diameter of from about 1 to about 25, and preferably from 1 to about 10 microns in average volume diameter, and narrow GSD of, for example, from about 1.15 to about 1.25 as measured on the Coulter Counter can be obtained, and which toners contain a wax component, such as a low molecular weight wax with from, for example, an $M_w$ of from about 1,000 to about 20,000, such as polyethylene or polypropylene available from a number of sources, such as Sanyo Chemicals of Japan, and wherein the wax is permanently, or substantially permanently contained in the toner. The resulting toners can be selected for known electrophotographic imaging, printing processes, including color processes and lithography, and wherein excellent release of the developed images results. In embodiments, the present invention is directed to a process comprised of dispersing a pigment and optionally toner additives like a charge control agent or additive in an aqueous mixture containing an ionic surfactant in an amount of from about 0.5 percent (weight percent throughout unless otherwise indicated) to about 10 percent, dispersing a wax in the aqueous mixture, or water mixture with nonionic or ionic surfactant in an amount of from about 0.5 percent to about 10 percent, and shearing the pigment and wax dispersions with a latex or resin prepared by emulsion polymerization comprised of suspended submicron particles of from, for example, about 0.01 micron to about 1 micron in volume average diameter in an aqueous solution containing a counterionic surfactant in amounts of from about 1 percent to about 10 percent with opposite charge to the ionic surfactant of the pigment dispersion, and nonionic surfactant in amounts of from about 0 percent to about 5 percent, thereby causing a flocculation of resin particles, wax, pigment particles and optional charge control agent, followed by heating at about 5° to about 40° C. below the resin Tg and preferably about 5° to about 25° C. below the resin Tg while stirring of the flocculent mixture, which is believed to form statically bound aggregates of from about 1 micron to about 10 microns in volume average diameter comprised of resin, wax pigment and optionally charge control particles, and thereafter heating the formed bound aggregates about above the Tg (glass transition temperature) of the resin. The size of the aforementioned statistically bonded aggregated particles can be controlled by adjusting the temperature in the below the resin Tg heating stage. An increase in the temperature causes an increase in the size of the aggregated particle. This process of aggregating submicron latex, wax and pigment particles is kinetically controlled, that is the temperature increases the process of aggregation. The higher the temperature during stirring, the quicker the aggregates are formed, for example from about 2 to about 10 times faster in embodiments, and the latex submicron particles are consumed more quickly. The temperature also controls in embodiments the particle size distribution of the aggregates, for example the higher the temperature the narrower the particle size distribution and this narrower distribution can be achieved in, for example, from about 0.5 to about 24 hours and preferably in about 1 to about 3 hours time. Heating the mixture above or in embodiments equal to the resin Tg generates toner particles with, for example, a particle volume average diameter of from about 1 to about 25 and preferably 10 microns. It is believed that during the heating stage the components of aggregated particles fuse together to form composite toner particles. In embodiments thereof, the present invention is directed to an in situ process comprised of first dispersing a pigment, such as HELIOGEN BLUE™ or HOSTAPERM PINK™, in an aqueous mixture containing a cationic surfactant such as benzalkonium chloride (SANIZOL B-50™), utilizing a high shearing device, such as a Brinkmann Polytron, microfluidizer or sonicator, dispersing a wax in the aqueous mixture, or water mixture with a nonionic or ionic surfactant by adding wax heated above its melting point to water containing a nonionic or ionic dispersant or surfactant while simultaneously subjecting the aqueous system to a high shearing device such as a Brinkmann Polytron, microfluidizer or sonicator; subsequently shearing a combination of the pigment and wax dispersions with a latex of suspended resin particles, such as poly(styrene butadiene acrylic acid), poly(styrene butylacrylate acrylic acid) or PLIOTONE™, a poly(styrene butadiene), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate (for example NEOGEN R™ or NEOGEN SC™), and a nonionic surfactant, such as alkyl phenoxy poly(ethylenoxy)ethanol (for example IGEPAL 897™ or ANTAROX 897™), thereby resulting in a flocculation, or heterocoagulation of the resin particles with the wax and pigment particles; and which, on further stirring for about 1 to about 3 hours while heating, for example, from about 35° to about 45° C., results in the formation of statically bound aggregates ranging in size of from about 0.5 micron to about 10 microns in volume average diameter as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. Thereafter, heating from about 5° to about 50° C. above the resin Tg provides for particle fusion or coalescence of the polymer, wax and pigment particles; followed by optional washing with, for example, hot water to remove surfactant; and drying whereby toner particles comprised of resin, wax and pigment with various particle size diameters can be obtained, such as from 1 to about 20, and preferably from 3 to 10 microns in volume average diameter. The aforementioned toners are especially useful for the development of colored images with excellent line and solid resolution, and wherein substantially no background deposits are present.

While not being desired to be limited by theory, it is believed that the flocculation or heterocoagulation is caused by the neutralization of the pigment mixture containing the pigment and ionic, such as cationic, surfactant absorbed on the pigment surface with the countercharging surfactants present in the wax dispersion and the resin mixture containing the resin particles and anionic surfactant absorbed on the resin particle. This process is kinetically controlled and an increase of, for example, from about 25° to about 45° C. of the temperature increases the flocculation, increasing from about 2.5 to 6 microns the size of the aggregated particles formed, and with a GSD charge of from about 1.39 to about 1.20 as measured on the Coulter Counter; the GSD is thus narrowed down since at high 45° to 55° C. (5° to 10° C. below the resin Tg) temperature the mobility of the particles increases, and as a result all the fines and submicron size particles are collected much faster, for example 14 hours as opposed to 2 hours, and more efficiently. Thereafter, heating the aggregates, for example, from about 5° to about 80° C. above the resin Tg fuses the aggregated particles or coalesces the particles to enable the formation of toner composites of polymer, wax, pigments and optional toner additives like charge control agents, and the like. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and thereby forming statically bounded aggregate particles by stirring and heating below the resin Tg; and thereafter, that is when the aggregates are formed, heating above the resin Tg to form stable toner composite particles. Of importance with respect to the processes of the present invention in embodiments is computer controlling the temperature of the heating to form the aggregates since the temperature can affect the rate of aggregation, the size of the aggregates and the particle size distribution of the aggregates. More specifically, the formation of aggregates is much faster, for example 6 to 7 times, when the temperature is 20° C. higher than room temperature, about 25° C., and the size of the aggregated particles, from 2.5 to 6 microns, increases with an increase in temperature. Also, an increase in the temperature of heating from room temperature to 45° C. improves the particle size distribution, for example with an increase in temperature below the resin Tg the particle size distribution, believed due to the faster collection of submicron particles, improves significantly. The latex blend or emulsion is comprised of resin or polymer, counterionic surfactant, and nonionic surfactant.

In reprographic technologies, such as xerographic and ionographic devices, toners with volume average diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle of from about 2 to about 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners, preferably of from about 3 to about 9 microns, are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to about 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns and with higher pigment loading such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns, and fixing thereafter results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns, and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns, whereby the pile height of the toner layer or layers is considered low and acceptable.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9 microns, and preferably 5 microns, are attained without resorting to classification processes, and wherein narrow geometric size distributions are attained, such as from about 1.16 to about 1.30, and preferably from about 1.16 to about 1.25. High toner yields are also attained, such as from about 90 percent to about 98 percent, in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

Also known is the addition of wax to dry toners prepared with classification and wherein there can be included in the toner compositions low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Wax is added into the resin/pigment system in known processes during the melt mixing stage either in a Banbury or extruder. The wax may or may not need the addition of an additional material, a compatibilizer, to ensure that the wax is well dispersed in the resin. When the wax is not well dispersed then large domains of wax form in the resin-wax blend. These domains of wax can be larger than 10 microns in size, thus when pulverized and jetted the resin/pigment/wax blend a quantity of waxy material, and some particles that contain only wax and pigment are formed. This is not considered acceptable for the electrophotographic process, and free wax in addition is known to cause dramatic changes to the flow behavior of a toner. In the situation of toners prepared by the emulsion-aggregation process which involves no melt blending step, there are two methods of providing the wax incorporation when it is needed to improve release or hot offset; place it on the surface of the toners after they have been fabricated or incorporate it in the materials that are aggregated together at the outset of the process. To accomplish the aforementioned, the wax should be in the form of a dispersion of wax in water in which the wax particles less than a micron in volume average diameter are suspended in water and stabilized by a dispersant system which is also generally a surfactant (nonionic or ionic) or a surfactant combination (nonionic and ionic or ionic-ionic). The emulsion-aggregation process of the present invention can select the fine particle wax aqueous dispersions.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, it is indicated in column 9, lines 50 to 55, that a polar monomer, such as acrylic acid, in the emulsion resin is necessary, and toner preparation is not obtained without the use, for example, of acrylic acid polar group, see Comparative Example I. In embodiments of the present invention, polymer polar acid groups are not needed, and toners can be prepared with resins, such as poly(styrene-butadiene) or PLIOTONE™, containing no polar acid groups.

In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. Similarly, the aforementioned disadvantages, for example poor GSD, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108 wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including in embodiments the effective preparation of small toner particles with narrow particle size distribution as a result of no classification; yields of toner are high; large amounts of power consumption are avoided; the process can be completed in rapid times, therefore rendering it attractive and economical; and it is a controllable process since the particle size of the toner can be rigidly controlled by, for example, controlling the temperature of the aggregation.

In copending application U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. Additionally, there is illustrated in U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference, there is illustrated a process for the preparation of toner compositions comprising (i) preparing a pigment dispersion in water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the resin Tg to form said toner composition comprised of polymeric resin, pigment and optionally a charge control agent.

In U.S. Pat. No. 5,370,963, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,344,738, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In U.S. Pat. No. 5,403,693, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In U.S. Pat. No. 5,418,108, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In U.S. Pat. No. 5,405,728, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) surfactant and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD, and wherein a wax component is contained in the toner.

In another object of the present invention there are provided simple and economical in situ chemical methods or processes for black and colored toner compositions by an aggregation process comprised of (i) preparing or providing a cationic pigment mixture containing pigment particles, and optionally charge control agents and other known optional additives dispersed in a water containing a cationic surfactant by shearing, microfluidizing or ultrasonifying; (ii) shearing the pigment mixture with a latex mixture comprised of a polymer resin, anionic surfactant and nonionic surfactant thereby causing a flocculation of the latex particles with pigment particles, which on further stirring allows for the formation of electrostatically stable aggregates of from about 0.5 to about 5 microns in average volume diameter as measured by the Coulter Counter; (iii) adding additional, for example 1 to 10 weight percent of anionic or nonionic, surfactant to the formed aggregates to, for example, increase their stability and to retain the particle size and particle size distribution during subsequent heating; and (iv) coalescing or fusing the aforementioned aggregated particle mixture by heat to toner composites, or a toner composition comprised of resin, pigment, wax component and charge additive.

In a further object of the present invention there is provided a process for the preparation of toner compositions containing wax permanently associated therewith and which toner has an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter.

In a further object of the present invention there is provided a process for the preparation of toner compositions with certain effective particle sizes by controlling the temperature of the aggregation which comprises stirring and heating below about the resin glass transition temperature (Tg).

In a further object of the present invention there is provided a process for the preparation of toners with particle size distribution, which can be improved from 1.4 to about 1.16 as measured by the Coulter Counter by increasing the temperature of aggregation from about 25° C. to about 45° C.

In a further object of the present invention there is provided a process that is rapid as, for example, the aggregation time can be reduced to below 1 to 3 hours by increasing the temperature from room, about 25° C., temperature (RT) to a temperature below 5° to 20° C. Tg, and wherein the process consumes from about 2 to about 8 hours.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions containing a wax component, and which toner has a low fusing temperature of from about 110° C. to about 150° C. and with excellent blocking characteristics at from about 50° C. to about 60° C., and wherein the toner also has excellent release characteristics, especially from fuser rolls present in electrostatic imaging systems.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of latex particles with pigment particles dispersed in water and a surfactant, and wherein the aggregated particles of toner size can then be caused to coalesce by, for example, heating. In embodiments, some factors of interest with respect to controlling particle size and particle size distribution include the concentration of the surfactant used for the pigment dispersion, the concentration of the resin component like acrylic acid in the latex, the temperature of coalescence, and the time of coalescence.

In another object of the present invention there are provided processes for the preparation of toner comprised of resin and pigment, which toner can be of a preselected size, such as from about 1 to about 10 microns in volume average diameter, and with narrow GSD by the aggregation of latex or emulsion particles, which aggregation can be accomplished with stirring in excess of 25° C., and below about the Tg of the toner resin, for example at 45° C., followed by heating the formed aggregates with wax above about the resin Tg to allow for coalescence; an essentially three step process of blending, aggregation and coalescence; and which process can in embodiments be completed in 8 or less hours. The process can comprise dispersing pigment particles in water/cationic surfactant using microfluidizer; blending the dispersion with a latex using a SD41 mixer, which allows continuous pumping and shearing at high speed, which is selected to break initially formed flocks or flocs, thus allowing controlled growth of the particles and better particle size distribution; the pigment/latex blend is then transferred into the kettle equipped with a mechanical stirrer and a temperature probe, and heated up to 35° C. or 45° C. to perform the aggregation. Negatively charged latex particles are aggregating with pigment particles dispersed in cationic surfactant, and the aggregation can be continued for 3 hours. This is usually sufficient time to provide a narrow GSD. The temperature is a factor in controlling the particle size and GSD in the initial stage of aggregation (kinetically controlled), the lower the temperature of aggregation, the smaller the particles; and the particle size and GSD achieved in the aggregation step can be "frozen" by addition of extra anionic surfactant prior to the coalescence. The resulting aggregated particles are heated 20° to 30° C. above their polymer Tg for coalescence; particles are filtered on the Buchner funnel and washed with hot water to remove the surfactants; and the particles are dried in a freeze dryer, spray dryer, or fluid bed dried.

These and other objects of the present invention are accomplished in embodiments by the provision of waxy toners and processes thereof. In embodiments of the present invention, there are provided processes for the economical direct preparation of toner compositions by improved flocculation or heterocoagulation, and coalescence, and wherein the temperature of aggregation can be utilized to control the final toner particle size, that is average volume diameter.

In embodiments, the present invention is directed to processes for the preparation of toner compositions, which comprises initially attaining or generating both a surfactant stabilized pigment dispersion and separately an aqueous dispersion of surfactant stabilized wax particles, and wherein the ionic pigment dispersion is generated, for example, by dispersing an aqueous mixture of a pigment or pigments, such as carbon black like REGAL 330®, phthalocyanine, quinacridone or RHODAMINE B™ type with a cationic surfactant, such as benzalkonium chloride, by utilizing a high shearing device, such as a Brinkmann Polytron, and wherein the wax dispersion is generated by, for example, heating an aqueous surfactant solution above the melting temperature of the wax and then adding wax to this solution while it is subject to high speed shearing devices, such as those selected to prepare the pigment dispersion; thereafter shearing a mixture of the pigment dispersion and the wax dispersion by utilizing a high shearing device, such as a Brinkmann Polytron, a sonicator or microfluidizer with a suspended resin mixture comprised of polymer components such as poly(styrene butadiene) or poly(styrene butylacrylate); and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below or at the resin Tg, for example from about 5° to about 15° C., and allowing the formation of electrostatically stabilized aggregates ranging from about 0.5 micron to about 10 microns; followed by heating above or at the resin Tg, for example from about 5° to about 50° C., to cause coalescence of the latex, pigment particles, and followed by washing with, for example, hot water to remove, for example, surfactant, and drying such as by use of an Aeromatic fluid bed dryer, freeze dryer, or spray dryer; whereby toner particles comprised of resin pigment, and optional charge control additive with various particle size diameters can be obtained, such as from about 1 to about 10 microns in average volume particle diameter as measured by the Coulter Counter.

Embodiments of the present invention include a process for the preparation of toner compositions comprised of resin, wax and pigment comprising (i) preparing or providing a pigment dispersion in water, which dispersion is comprised of a pigment, an ionic surfactant and optionally a charge control agent;

(ii) preparing or providing a wax dispersion in water, which dispersion is comprised of a wax and a dispersant, such as a nonionic or ionic surfactant;

(iii) shearing for a period of about 2 to about 30, and preferably from between about 5 to about 15 minutes a mixture of the wax dispersion and the pigment dispersion of (i) and (ii) with a latex mixture comprised of polymeric or resin particles in water and counterionic surfactant with a charge polarity of opposite sign to that of said ionic surfactant, and a nonionic surfactant;

(iv) heating the resulting homogenized mixture of (iii) below the resin Tg at a temperature of from about 35° to about 50° C. (or 5° to 20° C. below the resin Tg) thereby causing flocculation or heterocoagulation of the formed particles of pigment, resin and charge control agent to form electrostatically bounded toner size aggregates;

(v) adding additional ionic surfactant to the aggregated suspension to ensure that no additional or minimal aggregation takes place when the aggregates are subject to coalescence by heating above the resin Tg in step (v) of the process; and (vi) heating to, for example, from about 60° to about 95° C. the statically bound aggregated particles of (iii) to form said toner composition comprised of polymeric resin and pigment.

Also, in embodiments the present invention is directed to processes for the preparation of toner compositions which comprise (i) preparing an ionic pigment mixture by dispersing a pigment, such as carbon black like REGAL 330®, HOSTAPERM PINK™, or PV FAST BLUE™, of from about 2 to about 10 percent by weight of toner in an aqueous mixture containing a cationic surfactant such as dialkylbenzene dialkylammonium chloride like SANIZOL B-50™ available from Kao or MIRAPOL™ available from Alkaril Chemicals, and from about 0.5 to about 2 percent by weight of water utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) utilizing an aqueous dispersion of wax such as a polyethylene, polypropylene or styrenated acrylate, available, for example, from S. C. Johnson, containing a nonionic or ionic surfactant dispersant, (iii) adding the aforementioned ionic pigment mixture along with the wax dispersion in quantity, such that the wax component contributes between 1 and 10 percent of the final mass of the toner, to an aqueous suspension of resin particles comprised of, for example, poly(styrene-butylmethacrylate), PLIOTONE™ or poly(styrene-butadiene), and which resin particles are present in various effective amounts, such as from about 40 percent to about 98 percent by weight of the toner, and wherein the polymer resin latex particle size is from about 0.1 micron to about 3 microns in volume average diameter, and counterionic surfactant, such as an anionic surfactant like sodium dodecyl sulfate, dodecylbenzene sulfonate or NEOGEN R™, from about 0.5 to about 2 percent by weight of water, a nonionic surfactant, such as polyethylene glycol or polyoxyethylene glycol nonyl phenyl ether or IGEPAL 897™ obtained from GAF Chemical Company, from about 0.5 to about 3 percent by weight of water, thereby causing a flocculation or heterocoagulation of pigment, charge control additive and resin particles; (iv) diluting the mixture with water to enable from about 50 percent to about 15 percent of solids; (v) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer from about 250 to 500 rpm below or at the resin Tg at, for example, about 5° to 15° C. below the resin Tg at temperatures of about 35° to 50° C. to form electrostatically stable aggregates of from about 0.5 micron to about 5 microns in average volume diameter; (vi) adding additional anionic surfactant or nonionic surfactant in the amount of from 0.5 percent to 5 percent by weight of water to stabilize the aggregates formed in step (v), heating the statically bound aggregate composite particles at from about 60° C. to about 135° C. for a duration of about 60 minutes to about 600 minutes to form toner sized particles of from about 3 microns to about 7 microns in volume average diameter, and with a geometric size distribution of from about 1.2 to about 1.3 as measured by the Coulter Counter; and (vii) isolating the toner sized particles by washing, filtering and drying thereby providing composite toner particles comprised of resin and pigment. Flow additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner. The continuous stirring in step (iv) can be accomplished as indicated herein, and generally can be effected at from about 200 to about 1,000 rpm for from about 1 hour to about 24 hours, and preferably from about 12 to about 16 hours.

One preferred method of obtaining the pigment dispersion depends on the form of the pigment utilized. In some instances, pigments available in the wet cake form or concentrated form containing water can be easily dispersed utilizing a homogenizer or stirring. In other instances, pigments are available in a dry form, ,whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants.

In embodiments, the present invention relates to a process for the preparation of toner compositions with controlled particle size comprising:

(i) preparing a pigment dispersion in water, which dispersion is comprised of a pigment, an ionic surfactant, and optionally a charge control agent;

(ii) preparing or utilizing a commercially prepared and available dispersion of a wax in water, which dispersion is comprised of a wax, a dispersant being either a nonionic, ionic or a mixture of surfactants;

(iii) shearing for about 2 to about 30, and preferably about 15 to about 25 minutes a mixture of the pigment dispersion and the wax dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, wax, resin and charge control agent to form a uniform dispersion of solids;

(iv) heating, for example, from about 35° to about 50° C. the sheared blend at temperatures below about or equal to resin Tg, for example from about 5° to about 20° C., while continuously stirring to form electrostatically bounded relatively stable (for Coulter Counter measurements) toner size aggregates with narrow particle size distribution;

(v) adding an additional quantity of ionic surfactant in a quantity between 1 and 5 percent by weight to the aggregated suspension and reducing the stirring rate to between 100 and 250 rpm to ensure that no further aggregation takes place when the suspension is heated above the resin Tg in step (vi) of the process;

(vi) heating, for example,from about 60° to about 95° C., the statically bound aggregated particles at temperatures of about 5° to about 50° C. above the resin Tg, and wherein the resin Tg is in the range of about 50°, preferably 52° to about 65° C. to enable a mechanically stable, morphologically useful form of said toner composition comprised of polymeric resin, pigment and optionally a charge control agent;

(vii) separating the toner particles from the water by, for example, filtration; and (viii) drying the toner particles.

Embodiments of the present invention include a process for the preparation of toner compositions with controlled particle size comprising:

(i) preparing a pigment dispersion in water, which dispersion is comprised of a pigment of a diameter of from about 0.01 to about 1 micron, an ionic surfactant, and optionally a charge control agent;

(ii) preparing or utilizing a commercially prepared dispersion of a wax in water, which dispersion is comprised of a wax, a dispersant being either a nonionic, ionic or a mixture of surfactants;

(iii) shearing the mixture of the pigment dispersion and the wax dispersion with a latex blend comprised of resin particles of submicron size of from about 0.01 to about 1 micron, a counterionic surfactant with a charge polarity, positive or negative, of opposite sign to that of said ionic surfactant and a nonionic surfactant thereby causing a flocculation or heterocoagulation of the formed particles of pigment, resin and charge control agent to form a uniform dispersion of solids in the water and surfactant system;

(iv) heating the above sheared blend at a temperature of from about 5° to about 20° C. below the Tg of the resin particles while continuously stirring to form electrostatically bound or attached relatively stable (for Coulter Counter measurements) toner size aggregates with a narrow particle size distribution;

(v) adding an additional quantity of ionic surfactant in quantity between 1 and 5 percent by weight to the aggregated suspension and reducing the stirring rate to between 100 and 250 rpm to ensure that no further aggregation takes place when the suspension is heated above the resin Tg in step (vi) of the process;

(vi) heating the statically bound aggregated particles at a temperature of from about 5° to about 50° C. above the Tg of the resin to provide a mechanically stable, toner composition comprised of polymeric resin, pigment and optionally a charge control agent;

(vii) separating the said toner particles from the water by filtration; and (viii) drying the said toner particles.

In embodiments, the present invention is directed to a process for the preparation of toner compositions with controlled particle size, that is a particle size that remains essentially the same after aggregation, for example from 1 to 25, and preferably from about 3 to about 7 microns, comprising:

(i) preparing, or providing a pigment dispersion in water, which dispersion is comprised of a pigment, an ionic surfactant and optionally a charge control agent;

(ii) preparing, or providing a commercially obtained, for example from Michelman, Inc. with an Allied Signal polyethylene wax prepared dispersion of a wax in water, which dispersion is comprised of a wax, a dispersant being either a nonionic, ionic or a mixture of surfactants;

(iii) shearing a mixture of the wax and pigment dispersions with a latex blend comprised of resin of submicron size, a counterionic surfactant with a charge polarity of opposite sign to that of said ionic surfactant, and a nonionic surfactant thereby causing a flocculation or heterocoagulation of the formed particles of pigment, resin and charge control agent to form a uniform dispersion of solids in the water and surfactant;

(iv) heating the above sheared blend below about or about equal to the glass transition temperature (Tg) of the resin while continuously stirring to form electrostatically bound toner size aggregates with a narrow particle size distribution;

(v) adding an additional quantity of ionic surfactant in quantity between 1 and 5 percent by weight to the aggregated suspension and reducing the stirring rate to between 100 and 250 rpm to ensure that no further aggregation takes place when the suspension is heated above the resin Tg in (vi) of the process;

(vi) heating the statically bound aggregated particles above about or about equal to the Tg of the resin to provide a toner composition comprised of polymeric resin, pigment and optionally a charge control agent;

(vii) separating said toner particles from said water by filtration; and (viii) drying said toner particles.

In embodiments, the heating in (iv) is accomplished at a temperature of from about 29° to about 59° C.; the resin Tg in (iv) is from about 50° to about 80° C.; heating in (iv) is from about 5° to about 50° C. above the Tg; and wherein the resin Tg in (iv) is from about 50° to about 80° C.

In embodiments, heating below the glass transition temperature (Tg) can include heating at about the glass transition temperature or slightly higher. Heating above the Tg can include heating at about the Tg or slightly below the Tg, in embodiments.

Embodiments of the present invention include a process for the preparation of toner compositions with controlled particle size comprising:

(i) preparing a pigment dispersion in water, which dispersion is comprised of a pigment of a diameter of from about 0.01 to about 1 micron, an ionic surfactant, and optionally a charge control agent;

(ii) preparing or utilizing a commercially prepared dispersion of a wax in water, which dispersion is comprised of a wax, a dispersant being either a nonionic, ionic or a mixture of surfactants;

(iii) shearing a mixture of the wax and pigment dispersions with a latex blend comprised of resin particles of submicron size of from about 0.01 to about 1 micron, a counterionic surfactant with a charge polarity, for example positive or negative, of opposite sign to that of said ionic surfactant, which can be positive or negative, and a nonionic surfactant thereby causing a flocculation or heterocoagulation of the formed particles of pigment, resin and charge control agent to form a uniform dispersion of solids in the water and surfactant;

(iv) heating the above sheared blend at a temperature of from about 5° to about 20° C., and in embodiments about zero to about 20° C. below the Tg of the resin particles while continuously stirring to form electrostatically bounded or bound relatively stable (for Coulter Counter measurements) toner size aggregates with a narrow particle size distribution;

(v) adding further ionic surfactant in an amount of from between about 1 and about 5 percent by weight to the aggregated suspension and reducing the stirring rate to between 100 and 250 rpm to ensure that no, or minimal further aggregation takes place when the suspension is heated above the resin Tg in step (vi);

(vi) heating the statically bound aggregated particles at a temperature of from about 5° to about 50° C., and in embodiments about zero to about 50° C. above the Tg of the resin to provide a mechanically stable toner composition comprised of polymeric resin, pigment and optionally a charge control agent;

(vii) separating the toner particles from the water by filtration; and (viii) drying the toner particles.

In embodiments, the present invention is directed to a process for the preparation of toner compositions with controlled particle size comprising:

(i) preparing a pigment dispersion in water, which dispersion is comprised of a pigment and an ionic surfactant;

(ii) preparing or utilizing a commercially prepared dispersion of a wax in water, which dispersion is comprised of a wax, a dispersant being either a nonionic, ionic or a mixture of surfactants;

(iii) shearing the pigment dispersion with a latex blend comprised of resin of submicron size, a counterionic surfactant with a charge polarity of opposite sign to that of said ionic surfactant, and a nonionic surfactant thereby causing a flocculation or heterocoagulation of the formed particles of pigment and resin to form a uniform dispersion of solids in the water and surfactant;

(iv) heating the above sheared blend below about the glass transition temperature (Tg) of the resin while continuously stirring to form electrostatically bounded or bound toner size aggregates with a narrow particle size distribution;

(v) adding an additional quantity of ionic surfactant in a quantity between 1 and 5 percent by weight to the aggregated suspension and reducing the stirring rate to between 100 and 250 rpm to ensure that no further aggregation takes place when the suspension is heated above the resin Tg in step (vi); and (vi) heating the statically bound aggregated particles above about the Tg of the resin to provide a toner composition comprised of polymeric resin and pigment. Toner and developer compositions thereof are also encompassed by the present invention in embodiments.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl sytrene-butadiene), poly(methylmethacrylate-butadiene), poly(ethylmethacrylate-butadiene), poly(propylmethacrylate-butadiene), poly(butylmethacrylatebutadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc), PLASTHALL™ (Rohm & Hass), CYGAL™ (American Cyanamide), ARMCO™ (Armco Composites), CELANEX™ (Celanese Eng), RYNITE™ (DuPont), STYPOL™, and the like. The resins selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional, and such groups can be present in various amounts of from about 0.1 to about 10 percent by weight of the polymer resin. Known chain transfer agents, for example dodecanethiol, about 1 to about 10 percent, water soluble thiols such as butanethiol, propanethiol or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799®, CB5300®, CB5600®, MCX6369®, Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

Examples of waxes include those as illustrated herein such as polypropylenes and polyethylenes commercially available from Allied Chemical and Petrolite Corporation, wax emulsions available from Michaelman Inc. and the Daniels Products Company, Epolene N-15 commercially available from Eastman Chemical Products, Inc., Viscol 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight $M_w$ of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 1 percent by weight to about 5 percent by weight.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride) available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to about 4, and preferably from about 0.5 to about 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size and GSD achieved in the aggregation can be selected from the an ionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregated comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLES

Pigment dispersion: 140 grams of dry pigment PV FAST BLUE™ and 29.2 grams of cationic surfactant SANIZOL B-50™ were dispersed in 4,000 grams of water using an microfluidizing system.

Resin Suspension: A latex was prepared by the emulsion polymerization of styrene:butylacrylate and acrylic acid (82:18 with 2 pph acrylic acid) in nonionic/anionic surfactant solution (3 percent) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex, 60 percent water and 40 percent (weight percent throughout) solids comprised of a copolymer of polystyrene/polybutyl acrylate/polyacrylic acid, 82/18/2; the Tg of the latex dry sample was 53.1° C., as measured on a DuPont DSC; $M_w$=26,600, and $M_n$=1,200 as determined on Hewlett Packard GPC. The zeta potential as measured on Pen Kem Inc. Laser Zee Meter was −80 millivolts for the polymeric latex. The particle size of the latex as measured on Brookhaven BI-90 Particle Nanosizer was 147 nanometers. The aforementioned latex was then selected for the toner preparation in all the following Examples.

Wax Dispersion A: 26 grams of chloroparaffin wax (Aldrich Chemicals) were dissolved in 200 grams of dichloromethane and then dispersed in 600 grams of water containing 3 grams of the cationic surfactant SANIZOL B™ (Kao Company, Japan) and sheared at 10,000 rpm for 5 minutes using an IKA G-45M homogenizer. The resulting dispersion of organic material in water was then heated to 40° C. under a nitrogen blanket for an hour. The temperature was then raised to 50° C. and the dispersion was held at this temperature for 6 hours to remove all traces of the solvent dichloromethane. There results a cationic surfactant stabilized dispersion of the chloroparaffin wax in water. The wax particles in the dispersion were shown to be less than 1 micron in size by Coulter Counter size analysis.

COMPARATIVE EXAMPLE

Preparation of Toner Particles, With No Wax Incorporation:

208 Grams of the above pigment dispersion of the PV FAST BLUE™ were placed in the SD41 continuous blender along with 1.46 grams of SANIZOL B-50™ and 500 grams of deionized water. The aforementioned pigment dispersion was sheared for 3 minutes at 10,000 rpm. 325 Grams of the above latex were added to the pigment dispersion while the shearing continued. Shearing was continued for an extra 8 minutes at 10,000 rpm. The blend was then transferred into a kettle placed in the heating mantle and equipped with mechanical stirrer and temperature probe. The temperature of the mixture was raised from 25° C. (room temperature) to 45° C., and the aggregation was performed for 2 hours while stirring at a rate of 400 rpm. 70 Milliliters of a 20 percent solution of anionic surfactant (NEOGEN R™) was added and the stirring rate reduced to 100 rpm prior to raising the temperature of the aggregated particles in the kettle to 90° C. The heating was continued at 90° C. for 4 hours to coalesce the aggregated particles. The particle size of the coalesced material was determined to be 4.5 microns volume average diameter with a GSD of 1.20 as determined by Coulter Counter analysis. This measured size was identical to the size of the aggregates formed in the aggregation stage of the process where heating is restricted to a temperature below Tg. The particles were filtered, washed using deionized water, and dried on a freeze dryer. The resulting cyan toner was comprised of 95 percent resin of poly(styrene-co-butylacrylate- co-acrylic acid), and 5 percent of PV FAST BLUE™ pigment.

Solid area patches of this toner with a TMA (toner mass per unit area) of 1.2 grams/square centimeter on a paper substrate were fused using a laboratory fusing fixture employing a Xerox Corporation 5765 fuser roll subassembly modified to allow for controlled and adjustable temperature fuser conditions. The hot offset temperature (HOT) is determined by the first signs of toner being transferred from the paper to the fuser roll. This reference toner (without wax) was found to have a HOT of 180° C.

EXAMPLE I

Toner Containing Chlorinated Polyethylene Wax:

208 Grams of the above pigment dispersion (the same quantity as used in the Comparative Example above) containing 7 grams of pigment PV FAST BLUE™ and 1.46 grams of cationic surfactant SANIZOL B-50™ were combined with 250 grams of the chlorinated polyethylene wax prepared as above, and 300 grams of water containing 1.30 grams of SANIZOL B-50™ cationic surfactant were homogenized at 10,000 rpm for 2 minutes. 325 Grams of the resin suspension prepared as above (latex) were then added and the homogenization continued at 10,000 rpm for 8 minutes. The blend was then transferred to a kettle fitted with a stirrer and a thermometer and the blend was heated to 45° C. while stirring continuously at 500 rpm. After 2 hours at 45° C., 70 milliliters of a 20 percent solution of the anionic surfactant NEOGEN® was added to the aggregated system and the stirring rate decreased to 100 rpm. The aggregate slurry was then heated to 90° C. for 4 hours to coalesce the toner particles. The particle size of the toner produced in this experiment was 4.3 microns in volume average diameter with a GSD of 1.24 as determined by Coulter Counter analysis.

This toner was filtered, washed with water and freeze dried. The final toner was comprised of 90 percent of resin (styrene:butylacrylate:acrylic acid), 5 percent wax and 5 percent pigment.

The fusing behavior of this toner was determined using the same experimental conditions as reported for the Comparative Example toner above, and the hot offset temperature (HOT) was determined to be 200° C., some 20° C. greater than the HOT of the Comparative toner which contained no wax.

EXAMPLE II

Toner Containing Styrenated Acrylate Wax:

208 Grams of the above pigment dispersion (the same quantity as used in the Comparative Example above) containing 7 grams of pigment PV FAST BLUE™ and 1.46 grams of cationic surfactant SANIZOL B-50™ were combined with 14 grams of a JONCRYL 89™ wax dispersion (S. C. Johnson Company) containing 7 grams of wax (styrenated acrylic type) and 600 grams of water containing 1.46 grams of SANIZOL B-50™ cationic surfactant, and the resulting mixture was homogenized at 10,000 rpm for 2 minutes.

325 Grams of the resin suspension prepared as above (latex) were then added and the homogenization continued at 10,000 rpm for 8 minutes. The blend was then transferred to a kettle fitted with a stirrer and a thermometer, and the blend was heated to 45° C. while stirring continuously at 500 rpm. After 2 hours at 45° C., 70 milliliters of a 20 percent solution of the anionic surfactant NEOGEN® were added to the aggregated system and the stirring rate decreased to 100 rpm. The aggregate slurry was then heated to 90° C. for 4 hours to coalesce the toner particles. The particle size of the toner produced was 5.4 microns in volume average diameter with a GSD of 1.22 as determined by Coulter Counter analysis.

This toner was filtered, washed with water and freeze dried. The final toner was comprised of 90 percent of resin (styrene:butylacrylate:acrylic acid), 5 percent wax and 5 percent pigment.

The fusing behavior of this toner was determined using the same experimental conditions as reported for the Comparative toner above, and the hot offset temperature (HOT) was determined to be 200° C., which is 20° C. greater than the HOT of the Comparative toner which contained no wax.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions or toner particles comprising:

(i) providing an aqueous pigment dispersion comprised of a pigment, an ionic surfactant and optionally a charge control agent;

(ii) providing a wax dispersion comprised of wax, and a dispersant selected from the group consisting of nonionic surfactant, ionic surfactant and mixtures thereof;

(iii) shearing a mixture of the wax dispersion and the pigment dispersion with a latex or emulsion blend comprised of resin, a counterionic surfactant with a charge polarity of opposite sign to that of said ionic surfactant and a nonionic surfactant;

(iv) heating the above sheared blend below about the glass transition temperature (Tg) of the resin to form electrostatically bound toner size aggregates with a narrow particle size distribution;

(v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi);

(vi) heating the mixture of (v) above about or at the Tg of the resin; and optionally (vii) separating the toner particles from the aqueous slurry by filtration and thereafter optionally washing.

2. A process in accordance with claim 1 wherein the surfactant utilized in preparing the pigment dispersion is a cationic surfactant, and the counterionic surfactant present in the latex mixture is an anionic surfactant.

3. A process in accordance with claim 1 wherein the surfactant utilized in preparing the pigment dispersion is an anionic surfactant, and the counterionic surfactant present in the latex mixture is a cationic surfactant.

4. A process in accordance with claim 1 wherein the heating of the blend of latex, pigment, surfactants and optional charge control agent in (iii) is accomplished at temperatures of from about 20° C. to about 5° C. below the Tg of the resin for a duration of from about 0.5 hour to about 6 hours.

5. A process in accordance with claim 1 wherein the heating of the statically bound aggregate particles to form toner size composite particles comprised of pigment, resin and optional charge control agent is accomplished at a temperature of from about 10° C. above the Tg of the resin to about 95° C. for a duration of from about 1 hour to about 8 hours.

6. A process in accordance with claim 1 wherein the resin is selected from the group consisting of poly(styrene-butadiene), poly(paramethyl styrene-butadiene), poly(meta-methylstyrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly(alpham-ethylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

7. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

8. A process in accordance with claim 2 wherein the cationic surfactant is a quaternary ammonium salt.

9. A process in accordance with claim 1 wherein the pigment is carbon black, magnetite, cyan, yellow, magenta, and mixtures thereof.

10. A process in accordance with claim 1 wherein the wax has a weight average molecular weight of from about 1,000 to about 20,000.

11. A process in accordance with claim 1 wherein the wax is polypropylene, polyethylene, halogenated and sulfonated waxes generated from polypropylene and polyethylene, acrylate waxes styrenated acrylate waxes, or paraffin waxes.

12. A process in accordance with claim 1 wherein the toner particles isolated are from about 2 to about 15 microns in average volume diameter, and the geometric size distribution thereof is from about 1.15 to about 1.35.

13. A process in accordance with claim 1 wherein the aggregates formed in (iv) are from about 1 to about 10 microns in average volume diameter.

14. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and optional charge agent.

15. A process in accordance with claim 1 wherein the toner particles isolated are from about 3 to about 15 microns in average volume diameter, and the geometric size distribution thereof is from about 1.15 to about 1.30.

16. A process in accordance with claim 2 wherein the nonionic surfactant concentration is about 0.1 to about 5 weight percent of the toner components; and wherein the anionic surfactant concentration is about 0.1 to about 5 weight percent of the toner components.

17. A process in accordance with claim 1 wherein heating in (iv) is accomplished at a temperature of from about 5° C. to about 25° C. below the Tg.

18. A process in accordance with claim 1 wherein heating in (iv) is accomplished at a temperature of from about 29° to about 59° C.

19. A process in accordance with claim 1 wherein the resin Tg in (vi) is from about 50° to about 80° C.

20. A process in accordance with claim 1 wherein heating in (iv) is accomplished at a temperature of from about 5° to about 50° C. above the Tg.

21. A process in accordance with claim 1 wherein the resin Tg in (iv) is from about 50° to about 80° C.

22. A process in accordance with claim 1 wherein the resin Tg is 54° C. and heating in (iv) is from about 59° to about 104° C.

23. A process in accordance with claim 1 wherein the resin Tg in (iii) is from about 52° to about 65° C.; and the resin Tg in (iv) is from about 52° to about 65° C.

24. A process in accordance with claim 23 wherein the heating in (iii) is equal to or slightly above the resin Tg.

25. A process in accordance with claim 23 wherein the heating in (iv) is equal to or slightly above the resin Tg.

26. A process for the preparation of toner particles comprising:

(i) preparing a pigment dispersion, which dispersion is comprised of a pigment, and an ionic surfactant;

(ii) preparing a dispersion comprised of wax, and a dispersant selected from the group consisting of nonionic surfactant, ionic surfactant and mixtures thereof;

(iii) subsequently mixing for from about 2 to about 10 minutes the dispersions of (i) and (ii) followed by shearing the mixture resulting for a period of about 2 to about 25 minutes of wax dispersion and pigment dispersion with a latex or emulsion blend comprised of resin, a counterionic surfactant with a charge polarity of opposite sign to that of said ionic surfactant, and a nonionic surfactant;

(iv) heating the above sheared blend below about the glass transition temperature (Tg) of the resin to form a suspension of electrostatically bound toner size aggregates;

(v) adding additional ionic surfactant to the suspension of (iv);

(vi) heating the mixture of (v) above about the glass transition temperature (Tg) of the resin; and optionally (vii) separating the toner particles.

27. A process in accordance with claim 26 wherein filtration and washing is selected for (vii).

28. A process in accordance with claim 26 wherein the mixture in (iii) is comprised of from about 1 to about 40 percent by weight of wax.

29. A process in accordance with claim 1 wherein the mixture in (iii) is comprised of from about 1 to about 40 percent by weight of wax.

30. A process for the preparation of toner comprising:

(i) mixing an aqueous dispersion comprised of a pigment, and an ionic surfactant with a dispersion comprised of wax, and a dispersant selected from the group consisting of nonionic surfactant, ionic surfactant and mixtures thereof with a latex or emulsion blend comprised of resin, a counterionic surfactant with a charge polarity of opposite sign to that of said ionic surfactant, and a nonionic surfactant;

(ii) heating the above mixture of (i) below the glass transition temperature (Tg) of the resin to form electrostatically bound toner size aggregates, (iii) heating the mixture of (ii) above the Tg of the resin; and optionally (iv) separating the toner particles.

31. A process in accordance with claim 30 wherein subsequent to (ii) there is added to the mixture further ionic surfactant, and the aqueous dispersion contains water, and wherein the wax is substantially permanently dispersed in said toner.

* * * * *